United States Patent [19]

Neal et al.

[11] 3,983,009

[45] Sept. 28, 1976

[54] METHOD AND APPARATUS FOR DESTRUCTIVE DISTILLATION OF SOLID WASTES AND RECOVERY OF DISTILLED PRODUCTS

[76] Inventors: David A. Neal, 11424 Freeway Pl., NE., Albuquerque, N. Mex. 87123; Patrick L. Stone, 501 N. Mississippi, Ada, Okla. 74820

[22] Filed: Mar. 25, 1974

[21] Appl. No.: 454,138

[52] U.S. Cl. ..... 202/93; 202/211; 202/213; 202/265

[51] Int. Cl.[2] ..... C10B 9/00

[58] Field of Search ..... 201/2.5, 25, 28, 29, 201/36, 37; 202/85, 91, 99, 109, 117, 120, 211, 265, 213; 23/277 R, 277 C, 279; 126/224, 225, 112, 152

[56] References Cited

UNITED STATES PATENTS

| | | | |
|---|---|---|---|
| 1,229,637 | 6/1917 | Merkel | 201/25 |
| 1,563,271 | 11/1925 | Fogh | 201/29 |
| 1,773,959 | 8/1930 | Crow | 201/2.5 |
| 2,757,129 | 7/1956 | Reeves et al. | 201/37 |
| 3,362,887 | 1/1968 | Rodgers | 202/117 |
| 3,440,162 | 4/1969 | Lawson | 201/36 |
| 3,454,382 | 7/1969 | Hamilton | 202/265 |
| 3,676,365 | 7/1972 | Shirai | 201/29 |

*Primary Examiner*—Hiram H. Bernstein
*Attorney, Agent, or Firm*—James E. Snead

[57] ABSTRACT

A process for destructive distillation of solid wastes and an apparatus for achieving the process whereby organic solid waste material which has been shredded, is exposed to a pyrolytic process to remove water and organic materials by a pyrolytic process wherein the off gases, after having been fractionally distilled to extract useable combustion products, are recycled through the process to enhance the destructive distillation of the solid waste material.

5 Claims, 5 Drawing Figures

METHOD AND APPARATUS FOR DESTRUCTIVE DISTILLATION OF SOLID WASTES AND RECOVERY OF DISTILLED PRODUCTS

BACKGROUND OF THE INVENTION

The conception of this invention was brought about by a need for a process by which organic solid waste can be reduced in volume without the undesirable side effect of environmental pollution.

In order to achieve the objectives stated above, this invention provides a destructive distillation process for organic solid waste whereby the waste material is exposed to a pyrolytic process wherein hot gas moves into the waste material for destructive distillation and the off gas is collected and, after having been fractionally distilled to remove useable by-products, is recycled into the destructive distillation process. The residue resulting from the process as an end product is in the form of char and distillate. In such a system the pyrolysis unit must have special characteristics and this application discloses the pyrolytic retort for such system.

FIELD OF THE INVENTION

This invention is in the field of sanitary waste disposal process and apparatus.

BRIEF SUMMARY OF THE INVENTION

This invention is concerned with the destructive distillation of solid organic wastes in order to reduce their volume and at the same time produce useable products such as oils, pyroligenous liquor, methanol, acetone, combustible gases and a high carbon char. Additionally, an apparatus for carrying out the destructive distillation process is described. The process in general involves the pyrolysis of the solid organic waste with the end product being high carbon char, distillate and reusuable gas. The gas may be used in other combustion processes or may be recycled into the process of the present invention.

At present, the major method of mixed municipal refuse disposal is either by dumping, sanitary land fill or by incineration. Dumping is objectionable because it has been found to have an adverse effect on the environment, and is now prohibited by law or regulation in many areas. Sanitary land fills are undesirable for many reason including the large amount of land required and the long term production of methane by anerobic decomposition of organics making the land fill unuseable for human habitation. Simple incineration has the advantage of reducing the volume of the solid waste but the disadvantages of providing little in the way of reuseable by-products and the generation of aerosols causing air pollution.

It is therefor an object of this invention to provide a process whereby organic solid waste material may be reduced in volume by a destructive distillation process which process produces useable materials and reduces the volume of the solid waste.

A further object of this invention is to provide a destructive distillation process for organic solid waste material which is useful in a system which eliminates or reduces adverse environmental impact caused by the distillation process.

A further object of this invention is to provide a destructive distillation process for organic solid waste material which process results in useable products.

A further object of this invention is to provide a destructive distillation process for organic solid waste which produces high carbon char, useable gas distillates and combustible gas.

Other objects and advantages of the present invention will become obvious as the same is better understood by reference to the following specifications and accompanying drawings wherein.

Figure 1:
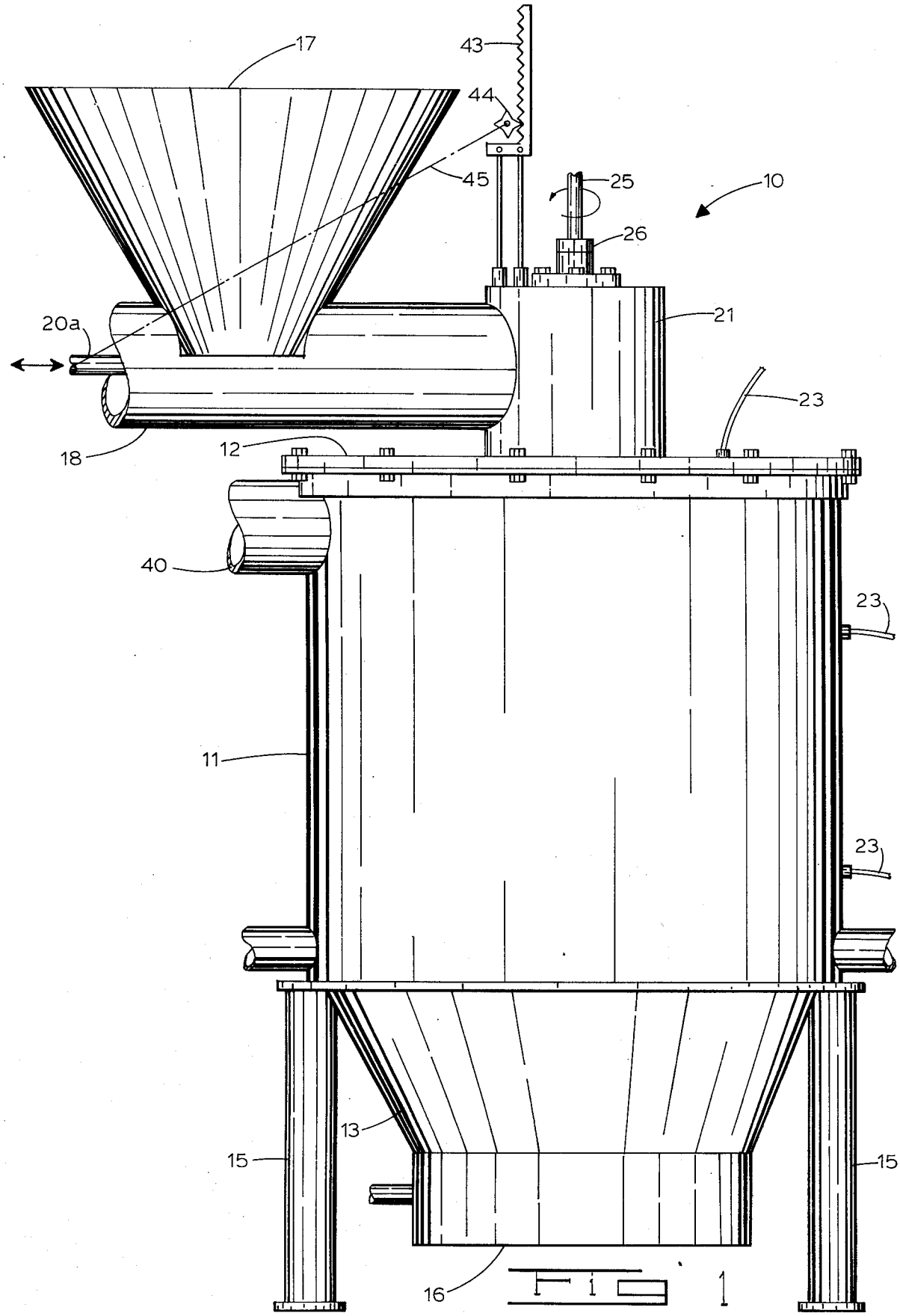
FIG. 1 is a vertical plan view of the apparatus for carrying out the process.

Referring now to the drawing wherein like numerals reflect like parts, it will be seen that the process of the present invention is carried out by the use of pyrolytic unit 10 which is at all times during operation closed to the atmosphere.

Pylotic unit 10, comprises waste receiving means, waste insertion means, an inlet waste gate, a retort 11 and ash disposal means. The retort 11, is preferably a cylindrical closed combustion chamber except that its bottom proper is terminated by a grate. Below the grate, the pyrolytic unit is provided with a char receiving bin and a char dump gate which isolates the interior of the retort from the atmosphere.

Retort 11 is provided with a refractory lining 14, a top plate 12 hermetically secured to the cylindrical body 11, and a grate assembly 33. The top place 12 supports a centrally located cylindrical waste inlet tube 21 which in turn provides a journal 26 at the closed top end thereof for purposes which will presently become apparent.

The entire assembly is supported in an upright position by any suitable means such as support members 15.

Tube 21 of pyrolytic unit 10, is connected to a waste inlet duct 18. When waste material is not in process of entering the pyrolytic unit, it is essential that the waste material inlet duct be closed at the tube 21 end. To this end a gate is provided and is shown as a vertically slideable gate 22.

Waste material is received by hopper 17 which opens into waste inlet duct 18. A ram **19—19*a* is horizontally translatable by power mechanism (not shown) to accept a charge of waste material when retracted and to insert the same into the retort when forced toward tube 21. The ram 19 comprises a cylinder 19*a* closed at the forward end, by ram head 19, i.e., the end facing the pyrolytic unit. The cylindrical portion 19*a* closes off the hopper outlet when the ram is forward to prevent waste from being dumped into the inlet duct behind the ram 19.**

Figure 2:
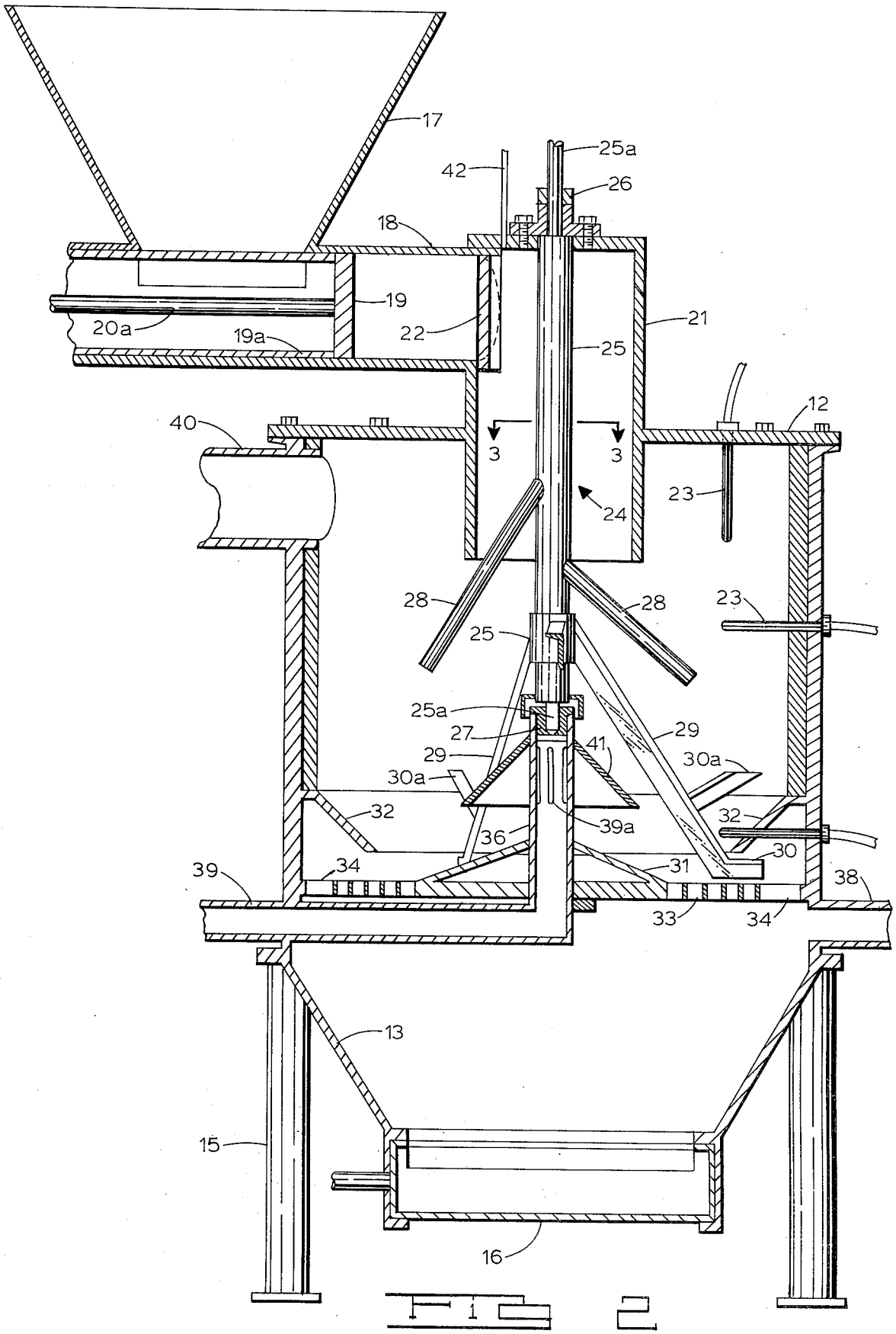
FIG. 2 is a vertical sectional view taken adjacent the center plan of the apparatus shown in FIG. 1 showing the internal arrangement and construction of the apparatus for carrying out the process.
Figure 3:
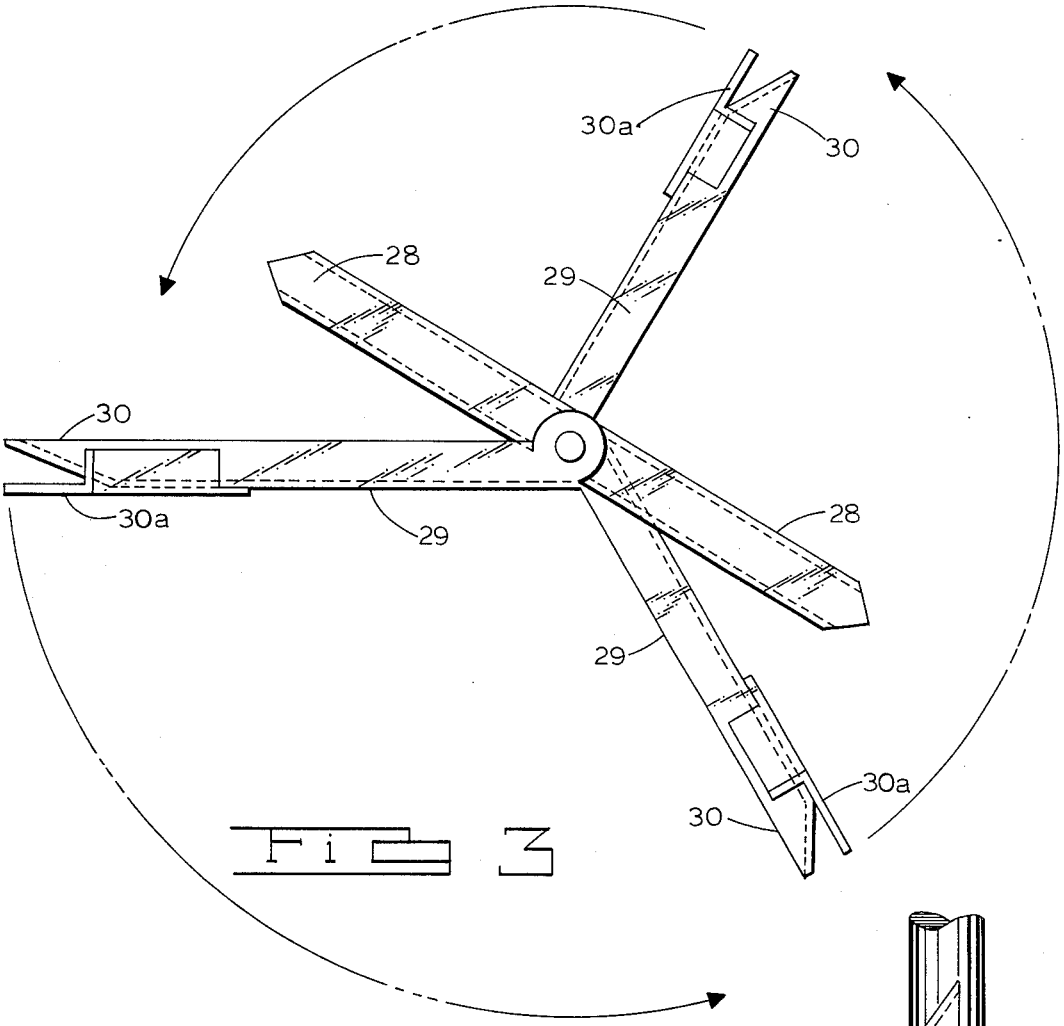
FIG. 3 is a horizontal sectional view taken on place 2—2 of a stirring assembly which comprises a part of the apparatus to carry out the described process.
Figure 5:
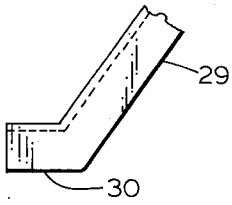
FIG. 5 is a partial side view of the sweep arm which comprises a part of the stirring assembly of the present invention.
Figure 4:
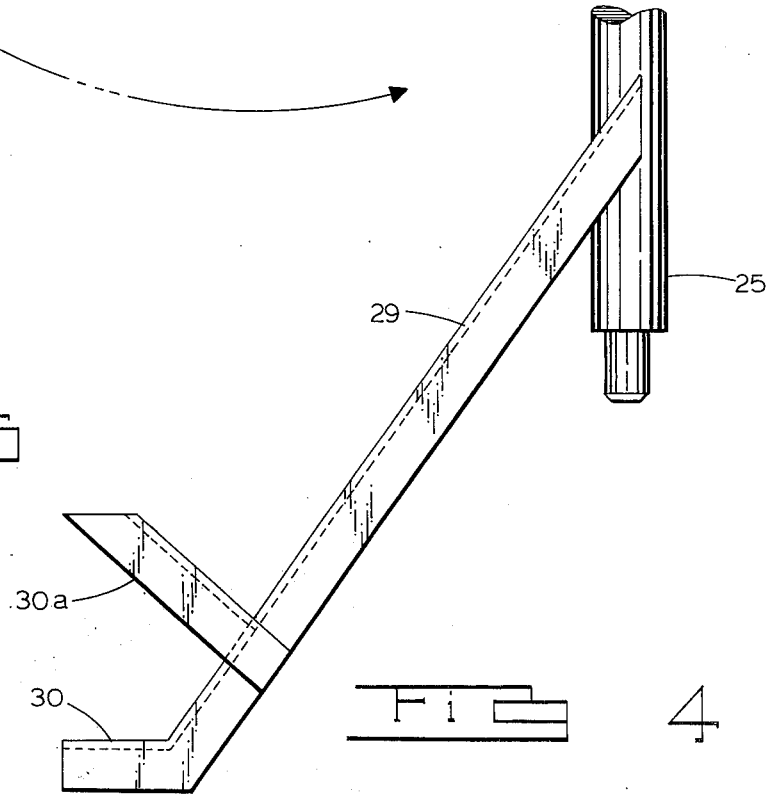
FIG. 4 is a side view of one of the sweep arms which comprise a part of the stirring assembly for the present invention.

As shown in FIG. 2, ash receiving bin 13 is funnel shaped and is provided with an ash removal assembly 16 at the bottom small end thereof. The ash removal mechanism includes a continuously gas tight arrangement such as drum valve 16 which is not common in the art.

As previously stated, the waste inlet duct must be closed off at the retort end when ram 19—19*a* is withdrawn so that the bottom of the hopper is in communication with the inlet duct in order to prevent combustibles and gasses from within the retort from being forced up through the hopper. To this end a gate is provided to close off the duct at the pyrolytic unit end when the ram is withdrawn to take on a fresh load of waste from hopper 17. Mechanically operated gate 22 is a curved plate to fit the curved juncture of inlet tube 21 and waste inlet duct 18. Gate 22 is slidably supported for vertical translation by a pair of actuator rods 42, best shown in FIG. 1. Gate 22 is connected to the actuator rods at its lateral edges in order not to obstruct the inlet port when the gate is opened for the ingress of waste material. The inlet valve actuator rods 42 can be vertically translated in any convenient manner and for purposes of illustration are shown to be coupled to rack 43 and pinion 44. Mechanical coupling means 45 are provided between pinion 44 and ram rod 20 to coordinate the opening and closing of valve 22 in proper phase with actuation of the ram 19—19*a*.

Pyrolytic unit inlet 21 is shown to be a cylindrical member fixedly secured through top plate 12 into the interior of retort 11. The connection between top plate 12 of retort 11 and the inlet cylinder is fixed and sealed in any suitable manner such as be welding.

A plurality of temperature measuring devices such as thermocouples 23 are inserted into retort 11 to measure the temperature at various zones within the retort. Such measuring devices are provided with means for transmitting the interior temperatures for readout and, preferably servo mechanisms, for most efficient control of inlet fresh air, recycled gases and waste material loading rate. All devices connected to or communicating between the inside of any part of the pyrolytic unit and the atmosphere must be substantially gas-tight as by packing or by suitable valves and gates.

A stirring assembly 24 is supported in the interior of retort 12, preferably along the vertical axis thereof. Stirring assembly 24 comprises shaft 25 having reduced bearing ends 25*a* and a plurality of stirring arms 38 and 29. The top end 25*a* of stirring shaft 25 is rotatably supported in a journal and thrust bearing 26. The bottom end of the stirring assembly is rotatably supported by bearing 27 of heat resistant material such as graphite. A plurality of stirring rods 28 are affixed to shaft 25 in an outwardly declining direction to project into the interior space of retort 11. In addition a plurality of sweep arms 29 project outwardly and downwardly from shaft 25 toward the grate defining the bottom of retort 11. Each sweep arm 29 is provided with a foot portion 30 which is parallel and adjacent to the top surface of grate 33. Each sweep arm 29 is also provided with a stirring arm 30*a* which projects upwardly perpendicular to the longitudinal axis of the sweep arm.

One function of stirring assembly is to stir, aerate and move material within retort 11, urging it outwardly from the center of the retort for substantially even distribution across the burning and distillation zones of the retort. The force of incoming material urges any feed material within retort 11 downward into the interior of the retort while the stirring action of stirring rods 28 and sweep arms 29 spread and aerate the material for the heating and pyrolytic processes. It is preferred that the stirring arms 28 be spacedly affixed. along shaft 25, depending on the height of the retort, with each lower arm being shorter than the next preceding arm so that the effect of movement of the arms is a spiral configuration. The effect of the movement of sweep arms 29 is to urge any material which they contact outward towards the wall and the bottom portion of retort 11. Projecting arms 30a extend upward into the feed material to contact and break up any masses or accumulations of feed material which could interfere with the destructive distillation process.

A vertical supporting column 36 is a part of air inlet pipe 39 and is centrally located to support shaft 24. A center cone 31 surrounds column 36 and projects outward and downward into contact with the grate 33 of retort 11. A baffle 32 extends inward and downward from the interior wall of retort 11 with a gap between the bottom of baffle 32 and grate 33 so that each foot 30 of sweep arms 29 extends beneath the baffle 32 toward the wall of retort 11. The bottom proper of retort 11 is formed by a grate 33 which is provided with enlarged apertures 34 at the outer edges thereof through which solid products of the process: such as char, fines, non-combustibles, such as concrete, iron scrap, etc., from retort 11 descend into char bin 13. Grate 33 is supported by riser portion 36 of air intake pipe 39. Riser portion 36 is provided with slots 39a to provide for the ingress of primary fresh air for combustion. Grate 33 provides for relatively small char particles to fall from retort 11 into char bin 13 whereas aperture 34 which may be annular is provided for the larger particles which are urged outward from the interior or retort 11 by feet 30 of sweep arms 29.

A combustion gas collection duct 40 is provided at or near the top of retort 11 in any suitable location such as shown in FIg. 2. This duct provides for the collection and further distribution of the off gases exhausted from the cumbustion process from within the interior of retort 11. Collection duct 40 may be connected to fractional distillation apparatus such as is well known in the art, whereby various components of the gas may be fractionally distilled and precipitated out.

The recycle gas inlet is provided into the interior of retory 11 through inlet pipe 38 inserted into the pyrolytic unit 10 just below grate 33. The combinatin of grate 33 with the action of sweeper arms 29 to remove large particles from the surface of the grate provides for the passage of recycle gas from inlet 38 through gate 33 into the interior of retort 11. The pressure of the incoming gas forces it upward into the interior of retort 11 into contact with the feed material in the interior of retort 11. Since the recycled gas is relatively cooler than the char formed at the bottom of retort 11, it absorbs heat from and cools the charred material conveying the heat thereby absorbed into the relatively cooler feed material entering retort 11 to thus preheat it and begin the destructive distillation process.

The pyrolysis of the feed material can and usually does require additional cumbustion air interior of the retort to combine with the recycle gas to produce heat for the pyrolysis of the feed material. Combustion air is provided into the interior of retort 11 by means of combustion air intake assembly 39. This assembly consists of an air intake pipe 39 extending from the exterior of retort 11 into its interior and supporting and communicating with riser pipe 36 in a manner shown in FIG. 2. A plurality of air exit ports 39*a* into the interior of retort 11. A conical shaped air diffuser 41 surrounds exit ports 39*a* to direct the diffusion and dispersion of cumbustion air into the burning waste in retort 11.

Pyrolysis within the interior of retort 11 results from the combination of recycle gas, combustion air and organic feed material in the lower portion of retort 11. The combustion gases rise through the incoming feed material for collection through one or more ducts 40 for distribution for further use. It will be seen that the arrangement of the various parts of stirring assembly 24 when combined with the force of incoming fee material results in the actual pyrolysis taking place in the lower portion of retort 11 with the hot gases rising through the incoming material to begin the destructive distillation process and drying of moisture from the feed material. The char from the thermally decomposed material descends through grate 33 and aperture 34 into char bin 13 where it can be disposed of in any desired manner. Obviously the descending char must overcome the pressure of incoming recycled gas in dropping into char bin 13.

The above described device is only one mechanism for carrying out the process of this invention. The parts of the invention can be rearranged, they can be modified and other devices manufactured to carry out the process.

The present invention provides a continuous process for the separation and reuse of a large amount of organic waste material. Moreover, the process can be controlled at various points to optimize its efficiency. It is conceivable that a pyrolysis unit can be made in portable fashion or in compact fashion and several units can be used in the same location. It is estimated that Refuse type 1 through 4 of the ASME Lexicon for Incinerator Technology contains 55–60% carbonaceous material. The process and apparatus of this invention reduces that particular material to a fraction of its original bulk and weight and extracts from the material useable by-products.

In operating the process of this invention the organic, carbonaceous feed material is separated in any suitable way, manually or mechanically from the inorganic and metallic material. The resulting organic feed material is shredded prior to introduction into the pyrolytic unit 10. A preferable size for the shredded material is ½ to 2 inches in diameter. A shredding mill such as the "eidal" type is suitable. The moisture content of the feed material is reduced to a maximum of 28% to avoid forming a mash which would tend to interface with the destructive distillation process. The prepared feed material is then subjected to a destructive distillation process by exposure to hot combustion gases in a field container, such as retort 11. The feed material is urged through the destructive distillation process with the off combustion gases being collected at a central location and the resulting char being removed from the bottom of retort 11. The off gases are then subjected to fractional distillation to remove useable products and the distillation effluent gas is recycled into the pyrolytic process for reuse. Incoming feed material is subjected to hot recycled gas to begin the destructive distillation process.

What is claimed is:

1. A pyrolytic unit for processing waste material in a closed system comprising a retort, waste material insertion means, and char collecting means, said retort being a cylindrical chamber supported with its axis vertical, said cylindrical chamber having (a) an elongated cylindrical wall, a top transverse closure plate, a bottom transverse grate plate, an elongated vertical waste inlet duct closed at the upper end by a closure plate hermetically affixed to and centrally located in such top transverse closure plate with its direction of elongation perpendicular to the plane of the transverse closure plate, a rotatable stirring assembly rotatably supported along the vertical axis of the retort, a horizontal waste inlet duct connected to and communicating with a side wall of the elongated vertical waste inlet duct outside the retort, one-way valve means in said horizontal waste inlet duct to isolate the interior of the retort from the atmosphere, means for forcing waste material through the waste inlet duct valve into the retort, said grate plate being supported within said retort cylindrical wall proximate the lower end thereof, a fresh air inlet duct diametrically supported in the cylindrical wall adjacent the lower surface of the grate plate, a vertical fresh air duct located along the vertical axis of the retort and having a closed upper end located in the central part proximate the retort combustion zone, said vertical fresh air duct having its lower end connected to and supported on the inner end of the fresh air inlet duct, a stirring assembly journal centrally located and passing through the (top wall) waste inlet duct closure plate, said stirring assembly comprising an elongated vertical rotatable shaft, rotatably supported by (the) lower and upper journals, said vertical rotatable shaft having an elongated extension passing upwardly through the upper journal for connection to rotating means, elongated waste stirring members affixed to the rotatable shaft with vertical spacing therebetween and declined downwardly from said shaft into the waste preheating zone, combustible material and char stirring arms affixed to the rotatable shaft at a common level thereon, said combustible waste and char stirring arms comprising outwardly and downwardly inclined arms and a foot member affixed to the lower end of each of said arms parallel to and closely proximate the upper surface of the grate plate, a downwardly inclined annular conical shield affixed to the cylindrical wall of the retort at the bottom of the combustion zone, at least one enlarged char exit port supported at the outer periphery of the grate plate under the annular conical shield, said enlarged char exit port being thus vertically shielded from contract with burning waste, said stirring foot members extending under the conical shield and adapted to pass over the said at least one enlarged char exit port, a recycled gas inlet duct supported in the cylindrical wall and porting within said retort below and adjacent the bottom surface of the grate plate, closed char collecting means connected to the bottom of the retort cylindrical wall, and unidirectional gate means in the char collecting means for intermittant removal of solid combustion residue without communicating the interior of the retort to the atmosphere.

2. The pyrolytic retort of claim 1 in which each of the combustible waste and char stirring arms has affixed to it above the conical shield at least one upwardly and outwardly extending stirring arm adapted to stir and reduce compaction of waste material.

3. The pyrolytic retort of claim 1 in which the interior wall of the cylindrical wall is refractory material, a plurality of temperature measuring devices penetrate the cylindrical and top walls and extend into the interior of the retort for termperature measurement thereof to provide controlability of the rate and completeness of the distillation and burning processes.

4. The pyrolytic retort of claim 1 in which said elongated waste inlet duct is a vertical cylinder hermetically affixed at an intermediate portion of its length to the wall of a central opening in the top wall and said diametrically disposed horizontal waste inlet duct is hermetically affixed to the upper portion of the vertical cylinder and communicates with the interior thereof, a ram slidably supported in the horizontal waste inlet duct and an elongated ram rod connected to the ram and extending out of the other end of the horizontal waste inlet duct for connection to translation means, a hopper vertically disposed over and communicating with the horizontal inlet duct for admitting waste thereinto when the ram is retracted whereby inward translation of the ram dumps a charge of wastes into said pyrolytic retort.

5. The pyrolytic retort of claim 4 in which the horizontal waste inlet duct valve means is operatively coupled to the ram actuating means to coordinate the operation thereof to at all times prevent communication between the retort interior and the waste inlet duct when open to the atmosphere.

* * * * *